United States Patent [19]

Betts

[11] 4,433,560

[45] Feb. 28, 1984

[54] PRESSER FOOT FOR A KNITTING MACHINE

[75] Inventor: Max W. Betts, Coventry, England

[73] Assignee: Courtaulds Limited, London, England

[21] Appl. No.: 406,120

[22] Filed: Aug. 6, 1982

Related U.S. Application Data

[63] Continuation of Ser. No. 167,206, Jul. 9, 1980.

[30] Foreign Application Priority Data

Jul. 13, 1979 [GB] United Kingdom ..... 7924463

[51] Int. Cl.[3] ..... D04B 7/04

[52] U.S. Cl. ..... 66/64

[58] Field of Search ..... 66/64, 60 R, 60 H

[56] References Cited

U.S. PATENT DOCUMENTS

| | | | |
|---|---|---|---|
| Re. 29,861 | 12/1978 | Dietschy | 66/64 |
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,842,623 | 10/1974 | Flavell et al. | 66/64 |
| 3,952,553 | 4/1976 | Kohler | 66/64 |
| 3,973,416 | 8/1976 | Kohler | 66/64 |
| 4,027,504 | 6/1977 | Dietschy | 66/64 |
| 4,081,973 | 4/1978 | Theys | 66/64 |
| 4,083,203 | 4/1978 | Theys | 66/64 |

*Primary Examiner*—Ronald Feldbaum

*Attorney, Agent, or Firm*—Davis, Hoxie, Faithfull & Hapgood

[57] ABSTRACT

In a flat V-bed knitting machine with independently operable needles there is provided a presser foot device comprising a presser foot carriage arranged for movement along the needle beds of the machine in synchronism with needle operation, and a support element extending down towards the gap between the walls of the needle beds and resiliently mounted in relation to the carriage for up-and-down movement. The presser foot device comprises (a) presser means fixedly mounted on the support element, the presser means having, in operation, leading and trailing ends and being capable of operating over a region extending from in front of the commencement of the rise of the needles for knitting to the area of needle cross-over, (b) a continuous stitch guide surface provided on the presser means in the neighborhood of each bed wall and arranged, in the operative position of the presser means, to extend downwardly and rearwardly, and then generally rearwardly, to push down and hold down stitches near said wall, and (c) a resilient presser foot also fixedly mounted on said support element to extend rearwardly from the presser means beneath the needle tent at a height, in the region of the trailing end of the presser means, above said stitch guide surfaces thereof.

8 Claims, 12 Drawing Figures

Figure 3:
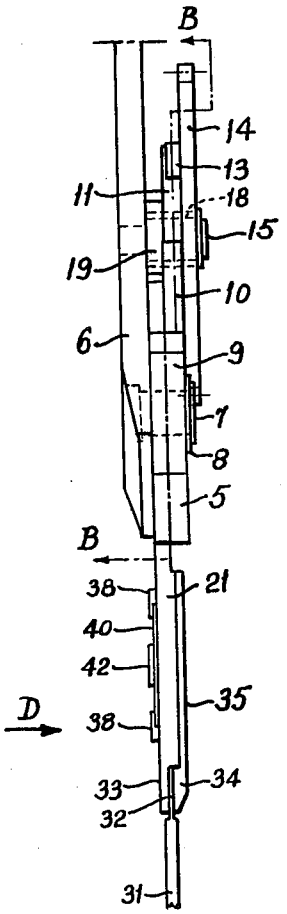

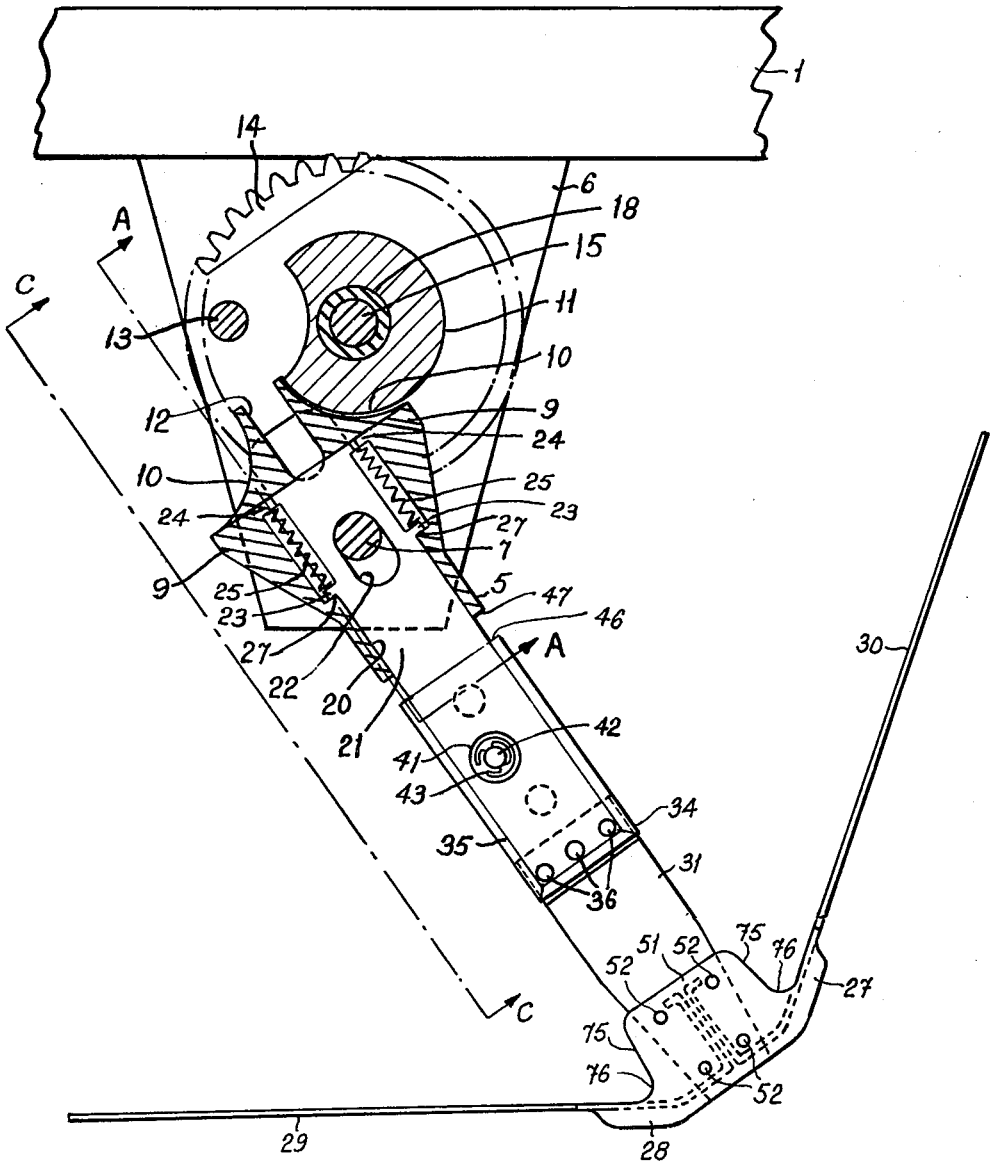
1
14
6
18
15
A
C
11
13
10
9
12
24
10
25
24
23
27
7
9
25
5
23
47
46
27
A
22
20
21
30
42
41
43
34
35
31
36
75
76
51
52
52
27
75
76
52
C
29
28

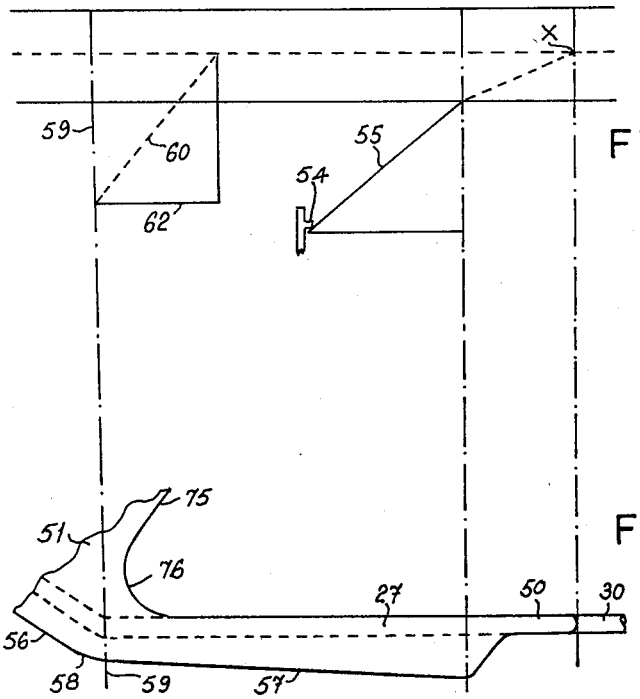
FIG. 7
FIG. 6
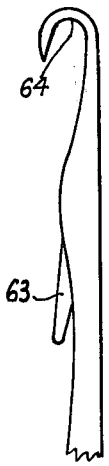
FIG. 8
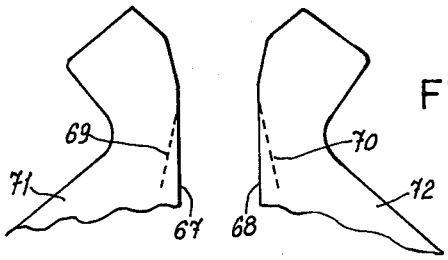
FIG. 9

PRESSER FOOT FOR A KNITTING MACHINE

This application is a continuation of application Ser. No. 169,206 filed July 9, 1980.

The present invention relates to a presser foot device for a flat V-bed knitting machine.

A flat V-bed knitting machine has two opposed needle beds arranged in an inverted V-formation and each containing an array of independently operable needles.

In the conventional V-flat machine in commercial use at present, the knitted fabric is pulled down away from the needles by means of nip rollers between which the fabric passes and this "roller take-down" as it is called, exerts on the knitted fabric, and thus on the loops held on the needles, the tension required to enable the knitting action of the needles to be carried out satisfactorily.

Recently, there have been introduced, for example by the company of Edouard Dubied & Cie S.A. of Switzerland, flat V-bed knitting machines which can be operated without roller take-down. One such machine is the Dubied JDR-PM. Flat machines of this kind are fitted with a presser foot which is an element extending, in its operational position, longitudinally of and between the needle beds, approximately at the level of the knock-over bits, in the region of the active needles.

In the JDR-PM machine, four presser feet are carried on the cam carriage of the knitting machine. The presser feet are arranged in pairs, each pair being associated with one of the cam systems of this double-system machine, and one presser foot of each pair is arranged to be in an operational position in relation to the needles of the machine during movement of the cam carriage in one direction along the needle beds, the other presser foot of each pair being operational during the return movement of the carriage.

The function of the presser foot is to hold down the loops of the knitted fabric when the needles rise to take more yarn, and thereby to allow the knitting action to proceed without any need to exert tension on the fabric from below.

One form of presser foot device is disclosed in British Patent Specification No. 1,288,043. In that device, a supporting member extends downwardly from a presser foot carrier, two presser feet are mounted on the lower end of the supporting member and project away from each other in substantially opposite directions, and the supporting member is movably mounted on the carrier so as to be movable to bring one of the two presser feet into an operative position for movement of the carrier in one direction along the needle beds and to bring the other presser foot into an operative position for movement of the carrier in the opposite direction along the needle beds. The presser foot carrier is arranged to carry the supporting member and the presser feet along the needle beds in synchronism with the activation of the needles and the presser feet are so located that the operative presser foot will hold down the loops on the needles as the needles rise.

Modified forms of presser foot device are disclosed in U.S. Patent Specification No. 4,027,504 and one of these comprises two principal presser feet arranged generally in the manner described above in connection with British Patent Specification No. 1,288,043 but spaced apart so that auxiliary presser feet can be mounted on a slide located between the principal presser feet and movable up and down on a downwardly extending supporting member which carries them. A spring urges said slide and the auxiliary presser feet mounted on it downwardly on said supporting member.

The auxiliary presser feet are therefore resiliently mounted in relation to the principal presser feet. In addition they have a field of action which overlaps the field of action of the principal presser feet. It has now been found that such resilient, movable mounting of the auxiliary presser feet in relation to the principal presser feet, in conjunction with fixed mounting of the principal presser feet, and an arrangement whereby the field of action of the auxiliary presser feet overlaps that of the principal presser feet is disadvantageous.

A further form of presser foot device is disclosed in United States Patent Specification No. 3,153,922 and this device again comprises a resiliently movable auxiliary presser foot which, in operation, occupies a leading position and a fixedly mounted principal presser foot which is in a trailing position.

In the presser foot device of the present invention, a leading presser means, operative in the region of each of the opposed needle beds, is fixedly mounted, together with a trailing presser foot, on a support element which is capable of resilient up-and-down movement in relation to a carriage on which it is mounted so that, in use, presser means and presser foot undergo resilient up-and-down movement together.

Thus, according to the present invention, a presser foot device for a flat V-bed knitting machine with independently operable needles comprises a presser foot carriage adapted for movement along the needle beds of the machine in synchronism with needle operation, a support element extending, when the device is fitted to the machine, down towards the gap between the needle beds and resiliently mounted in relation to said carriage for up-and-down movement, and presser means fixedly mounted on said support element and capable of operating over a region extending from in front of the commencement of the rise of the needles for knitting to the area of needle cross-over, said means providing in the neighbourhood of each bed wall a continuous stitch guide surface inclined, in the operative position of said presser means, downwardly and rearwardly and then rearwardly, and arranged to push down and hold down stitches near said wall; and further comprises a resilient presser foot also fixedly mounted on said support element to extend rearwardly from said presser means beneath the needle tent at a height, in the region of the trailing end of said presser means, above said stitch guide surfaces thereof.

Advantageously, a pair of presser feet are mounted on said support element and extend in opposite directions therefrom and a pair of presser means are also mounted on said support element and also extend in opposite directions therefrom, and one or other of the presser feet, with its associated presser means, is brought to the operative position by movement of the support element in a vertical plane between the two needle beds.

The or each presser means may comprise a pair of curved plates each of which, in its operative position when the presser device is fitted to a knitting machine, has a portion located in the neighbourhood of a respective bed wall and a trailing end location in the central region between the two needle beds.

Advantageously, each curved plate curves smoothly from the location near the bed wall to the location in the central region between the two needle beds. Each curved plate may have an end region extending parallel to the needle beds and located close to a part of the presser foot. This shape of presser means assists the presser means in pushing past yarn carriers on the knitting machine during movement of the presser means along the needle beds in the non-operative position of the presser means.

When the presser foot device comprises a pair of presser means of the construction just described, the two curved plates (belonging to different presser means) associated with the same needle bed wall may be formed in one piece together with a base plate located between them and by which they may conveniently be secured, by means of adhesive, to a blade of carbon fibre reinforced composite material having projecting studs engaged in apertures in the base plate. The blade is secured to the lower part of the support element and carries the presser feet which are formed of wire embedded in the composite material.

Figure 2:
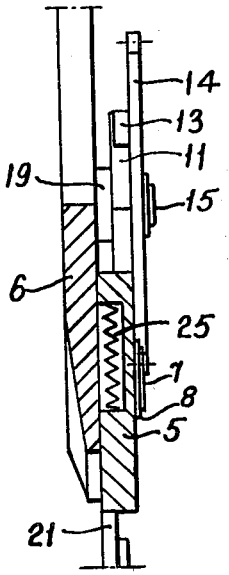
Figure 4:
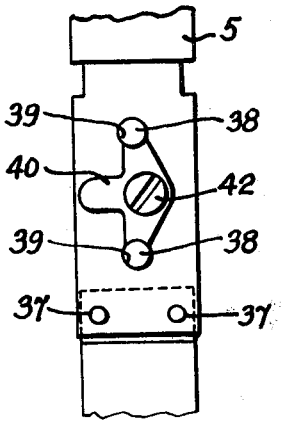
Figure 5:
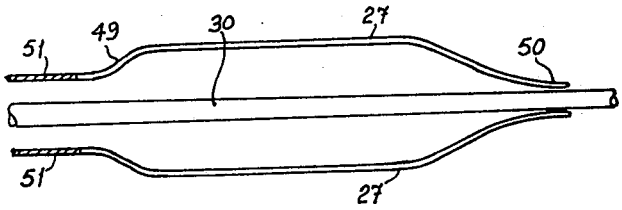
Figure 10:
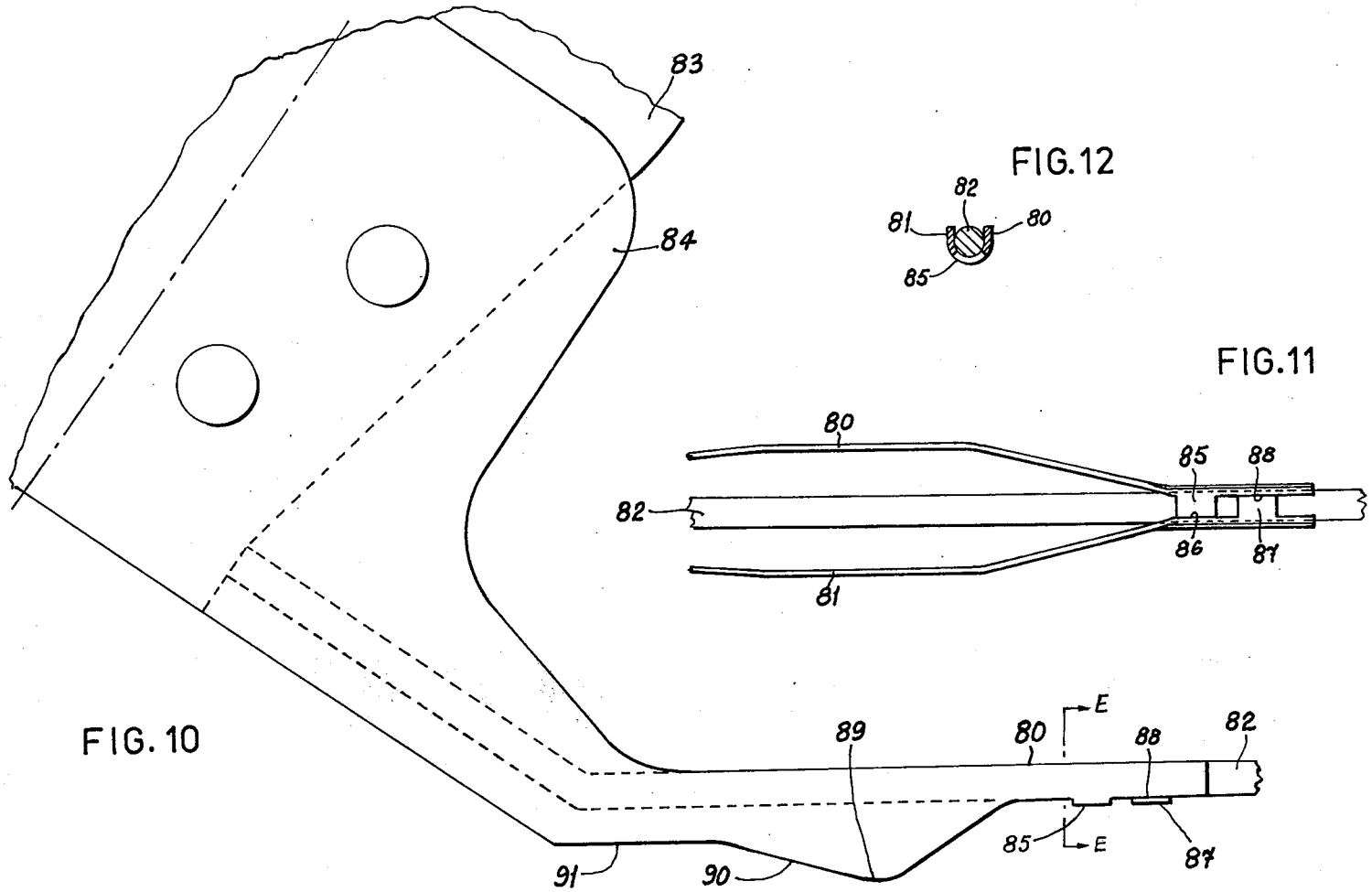

The invention will be further described, by way of example, with reference to the accompanying drawings in which:

FIG. 1 is an elevation, sectional on the line B—B of FIG. 3, of a presser foot device according to the invention, FIG. 2 is a section on the line A—A of FIG. 1, FIG. 3 is a side view of part of the presser foot device of FIG. 1, as viewed from the plane C—C in FIG. 1, FIG. 4 is a view in the direction of the arrow D in FIG. 3, FIG. 5 is a plan on a larger scale than FIG. 1 of part of a presser means and a presser foot in the device of FIG. 1, FIG. 6 is a side view of the parts of the presser means and presser foot shown in FIG. 5, FIG. 7 is a diagram illustrating the position of a presser means and presser foot of FIG. 1 in relation to an associated cam system in the knitting machine on which the device of FIG. 1 is fitted, FIG. 8 is a side view of part of a needle in the machine on which the device of FIG. 1 is fitted, FIG. 9 is a diagram illustrating a desirable form of needle bed for a knitting machine on which the device of FIG. 1 is fitted, FIG. 10 is a side view of part of further presser means for a presser device according to the invention, FIG. 11 is a view from the underside of the presser means of FIG. 10 and an associated presser foot, and FIG. 12 is a section on the line E—E of FIG. 10.

The presser foot device shown in FIG. 1 comprises a presser foot carriage, part only of the frame 1 of which is shown. The presser foot carriage is mounted on the cam box of a flat V-bed knitting machine (not shown) and thus moves to-and-fro along the needle beds of the machine with the cam box, and therefore in synchronism with the operation of the needles of the machine, such operation being effected by the cams in the cam box.

An arm 5 is pivotally mounted on a supporting plate 6 of the presser foot carriage by means of a stud 7 on which it is secured by a circlip 8. The arm 5 has wings 9 formed with arcuate surfaces 10 for co-operation with a cut-away boss 11 mounted on the plate 6. A slot 12 is formed in the arm 5 for co-operation with a pin 13 fixed on a toothed wheel 14 of a Geneva gear mechanism. The wheel 14 is rotatably mounted on a stud 15 secured on the plate 6, and a spacer 18 surrounds the part of the stud 15 which projects out of the plate 6 and a washer 19 spaces the wheel 14 from the plate 6. When the knitting machine on which the presser foot device is fitted is operated, the wheel 14 is rotated at the end of each traverse of the cam box, the rotation being effected by means of a rack (not shown) meshing with the toothed wheel 14 and moved longitudinally by a fixed stop on the machine each time the cam box reaches the end of a traverse of the needle beds. Such an arrangement, which has the purpose of bringing an appropriate presser foot into the operative position, is well known and is disclosed, for example in British Patent Specification No. 1,288,043. It is therefore not further described here.

Rotation of the wheel 14 caused as described above, brings about pivotal movement of the arm 5 to an alternative position to that shown in FIG. 1 appropriate for movement of the presser foot device in the opposite direction along the needle beds. The pivoting movement of the arm 5 is, in fact, brought about by the pin 13 which engages in the slot 12 as the wheel 14 turns. The cut-away portion of the boss 11 allows the end of the arm 5 to swing over and the arcuate surface 10 of the left-hand wing 9 in FIG. 1 engages the cylindrical surface of the boss 11 thus locking the arm 5 in its new position in which it is inclined downwardly and to the left in FIG. 1.

A support element 21 is slidable in a channel 20 formed in the arm 5. The element 21 has a slot 22 to allow passage through it of the stud 7 and is retained in the channel 20 by the plate 6. In the region of the slot 22, the element 21 is formed with shoulders 23 and at the upper end of the channel 20 are projecting abutments 24. Between each shoulder 23 and the corresponding abutment 24 is located a helical spring 25 and the springs 25 urge the support element 21 downwardly in FIG. 1 until the shoulders 23 each abut against a corresponding ledge 26 in a side wall of the channel 20. The support element 21 can be pushed upwardly in FIG. 1 against the force of the springs 25 and the element 21 is therefore resiliently mounted for up-and-down movement in relation to the presser foot carriage 1.

On the lower end of the support element 21 are mounted a pair of presser means 27, a pair of presser means 28 and a pair of presser feet 29 and 30. The presser means 27 and 28 and the presser feet 29 and 30 are rigidly carried on a blade 31 made of carbon fibre composite. The blade 31 is secured on the support element 21 by three studs 36 which are set in a thickened end portion 34 of a coverplate 35 fixed on the support element 21 (see FIG. 3). The studs 36 extend through corresponding holes in a thinner metal end portion 32 of the blade 31 part of which is embedded in the composite material. The end portion 32 lies between the thickened end portion 34 of the coverplate 35 and a lip 33 on the support element 21. The two outer studs 36 extend into holes 37 in the lip 33 but the centre stud is shorter and merely abuts against the surface of the lip 33. The coverplate 35 has two pins 38 which extend through holes 39 in the support element 21 to secure the coverplate 35 on the element 21. The pins 38 project from the support element 21 and are slotted to receive the arms of a plate 40 which locks the coverplate 35 on the element 21. A hole 41 in the coverplate 35 accommodates the head of a stud 42 which carries the plate 40, and a circlip 43 locks the stud 42 and the plate 40 on the support element 21. When the coverplate 35 is located on the element 21, the end portion 32 is spaced from the lip 33 by a distance greater than the thickness of the end portion 32 of the blade 31 so that the blade has some freedom of movement between the end portion 32 and the lip 33, thus allowing the presser feet 29 and 30 and the presser means 27 and 28 some lateral movement between the needle beds of the knitting machine. An arrangement for a presser foot allowing lateral movement in this way is described and claimed in British Patent Specification No. 1,418,314.

In FIG. 1, the left-hand lower pair of presser means 28 and the associated presser foot 30 are in operative positions to push down and hold down knitted fabric. The height of the presser foot carriage is adjusted, by means not shown, so that when the presser foot meets knitted fabric held on the needles it will ride up slightly from the position shown in FIG. 1, this movement being possible because of upward sliding movement of the support element 21 in the channel 20 against the springs 25. Since the presser means 27 and 28 and the presser feet 29 and 30 are all fixedly mounted on the blade 31, the presser means and presser feet move up and down together under the influence of the springs 25 as the presser foot carriage 1 moves along the needle beds of a V-flat knitting machine.

The two presser means 27 and 28 adjacent the same needle bed in the machine are integral parts of a thin beryllium-copper alloy sheet shaped to form the two presser means and a base plate 51 located between them. The two base plates 51 are secured on opposite faces of the blade 31 by means of adhesive and are located on the blade by studs 52 engaged in apertures in the base plates. The base plates 51 and presser means 27 and 28 may alternatively be made of spring steel. Each of the presser means 27 and 28 has a similar shape which can be clearly seen in FIGS. 5 and 6. In the trailing direction, that is the direction to the right in FIG. 5, each presser means 27 (or 28), first diverges from the central plane of the presser foot device at 49, then extends parallel to that plane, and at its trailing end curves back towards the central plane, the final end part 50 of the presser means also extending parallel to that plane. From FIG. 6, which is a side view of the presser means 27, it can be seen that the trailing end part 50 of each presser means 27 has a much smaller depth than the main body of the presser means, the trailing end part 50 extending from the upper part of the main body. Each plate 51 is wide enough and slopes downwardly and outwardly at each of its edges 75 to merge in a curve 76 with the adjacent presser means 27 or 28 so that it is difficult for the nose of a yarn carrier to enter the spaces defined by the curves 76.

Each of the presser means 27 and 28 is capable of operating over a region extending from in front of the commencement of the rise of the needles for knitting to the area of needle cross-over. This can be seen from FIG. 7 which is aligned with FIG. 6 and which shows the slope of the raising cam and the path of the tip of the needle hook across the bed gap in the machine in which the presser foot device illustrated is fitted. Also illustrated in FIG. 7 is the movement of presser means 27 as a consequence of the movement of the support element 21 on the arm 5.

The rise of a needle for knitting commences in FIG. 7 with the impingement of a needle butt 54 of a needle at stitch length position on the upwardly sloping surface 55 of a raising cam shown at a typical angle of 50°. Even when the support element 21 is raised as far as possible on the arm 5, the upwardly sloping leading surface 56 (FIG. 6) of the presser means 27 is in advance of the position at which the needles commence to rise. The forward position of the radiused portion 58 of the presser means 27, which portion divides the leading surface 56 from the horizontal stitch control surface 57 of the means 27, is marked by a line 59 in FIG. 7, and the movement of the support element 21 is indicated by the line 60 in FIG. 7. Thus, the position of the portion 58 for any position of the support element 21 can be read off from FIG. 7 by projecting a line vertically downwards from the line 60 on to the line 62.

The raising cam surface 55 in FIG. 7 is shown only as high as the point at which a needle raised by the cam is brought to the "Fleur le Jack" position in which the inner surface 64 (FIG. 8) of the needle hook is flush with the knock-over-bits of the machine. In this position of the needle the stitch length is zero. It can be seen from FIG. 6 that the start of the final tapering and narrowed part 50 of each presser means 27 (or 28) is located at the Fleur le Jack position in relation to the associated raising cam when the corresponding support element 21 (together with the presser means 27) is in its lowest and furthest forward position.

The only portions of the presser means 27 extending behind the Fleur le Jack position in the lowest position of the presser means are the tapered trailing ends. The presser means 27 (and 28) thus extend rearwardly, in their operative position, whatever the height position of the support element 21, to at least the area of the needle cross-over point marked "X" in FIG. 7.

As is clear from FIGS. 6 and 7, the downwardly and rearwardly inclined guide surface 56 is always located ahead of the raising cam 55 (in front of the commencement of needle rise) whatever the height position of the support element 21.

The shape of each of the presser means 27 and 28 and the resilient nature of the material from which the presser means are made enable the means to be bent so as to touch the needle bed front walls and thus provide, in the neighbourhood of each bed wall, a continuous stitch guide surface (the surface 56 and the surface 57) inclined first downwardly and rearwardly (in relation to the trailing direction when operative) and then rearwardly, and arranged to push down and hold down stitches at locations near the adjacent bed wall.

In the presser device shown, each surface 56 is inclined at an angle of 35° to the horizontal (the same angle as the support element 21 makes with the vertical) in the operative position. The surface 57 is inclined very slightly (less than 5°) to the horizontal in a downward and rearward direction (in its operative position).

The surfaces 56 in fact exert an important camming action pushing down any raised stitches on the needles before the needles begin their rising movement and reducing considerably or even eliminating the possibility of a needle hook re-penetrating a loop already on the needle.

However, it is also important that the presser means 27 (and 28) should be short enough to end in advance of the position where any substantial stretching of the loops occurs in their movement down the shanks of the rising needles and over the needle latches 63 (FIG. 8). This avoids risk of stretching the loops of rib structures, which extend between the two needle beds, too far, by forcing adjacent loops simulatneously over the latches of opposed needles and beneath the presser means 27 or 28.

The presser foot 29 (the foot 30 is of similar construction and form) is long enough to extend rearwardly from the presser means 27 and beneath the tent created by the needles in their raised positions, that is the presser foot 29 extends substantially to the rear of the needle cross-over point X in FIG. 7.

The presser feet 29 and 30 are made of resilient material and are inclined downwardly and rearwardly, (in relation to the trailing direction in the operative position) for example at an angle of 5° from the position of the portion 58, or extend horizontally from the portion 58 and have a trailing end which is inclined downwardly and rearwardly at an angle in excess of 5°. The object in both cases is to cause the presser foot to exert a downward force on the loops of rib knitted structures crossing between the needle beds beneath the tent of the needles. The resilient nature of the presser feet nevertheless allows them to be pushed up by the knitting high into the needle tent.

However, the fields of action of the presser feet 29 and 30 must not overlap with those of the associated presser means 27 and 28. Thus, as is clearly shown in FIG. 6, in the region of the trailing end of the presser means 27, the presser foot 29 is at a height substantially above the level of the stitch guide surface 57. Since the presser foot 29 and the presser means 27 are both fixedly mounted in relation to the support element 21, their height difference in this region cannot alter significantly and thus the presser foot 29 cannot exert any action on the knitted loops in this region. This is important because the presser means is terminated in the area of the needle cross-over specifically in order that there shall be no action on the knitted loops just to the rear of this area, for the reasons set out above. The effective field of action of each presser foot in the presser foot device illustrated is in fact substantially to the rear of the field of action of the associated presser means, and is thus in a region where the resilient nature of the presser foot allows it considerable vertical movement in response to pressure from the knitted loops independently of the vertical movement of the support element 21.

FIG. 9 illustrates an advantageous form of needle bed for use in conjunction with the presser foot device of FIG. 1. The needle bed fronts 67 and 68 are parallel to one another and do not diverge downwardly as do the conventional bed fronts 69 and 70 shown in broken lines in the Figure. Thus, the presser means 27 and 28 are better able to exert effective control on knitted loops at any height close to the needle beds 71 and 72.

The presser foot device of FIGS. 10 and 11 is similar in many respects to that of FIGS. 1 to 7. The part of the device of FIGS. 10 and 11 shown has presser means comprising curved plates 80 and 81 and a presser foot 82 and is in an attitude in FIG. 10 suitable for movement from right to left along the needle beds. As in the device of FIGS. 1 to 7, similar parts to those shown in FIGS. 10 and 11 are present for use when the device is moved in the opposite direction along the needle beds.

The presser foot 82 is made of resilient wire and is mounted by embedding in a blade 83 of carbon fibre composite material.

The plate 80 is integral with a base plate 84 secured to the blade 83. In the region of the trailing end of the plate 80 an arcuate strip 85 extends from the lower edge of the latter beneath the presser foot 82 and is secured to the lower edge of the plate 81, for example by welding at 86. Adjacent to the strip 85, a second arcuate strip 87 extends from the lower edge of the plate 81 beneath the presser foot 82 and is secured to the lower edge of the plate 80, for example by welding at 88.

The strips 85 and 87 provide a cradle restricting downward movement of the presser foot 82 but allowing it to move upward.

The plate 80 is formed with a downward protrusion 89 constituting part of a continuous stitch guide surface to push down and hold down stitches near a needle bed of a knitting machine. The protrusion 89 has a leading surface 90 inclined downwardly and rearwardly, in relation to the direction of movement of the plate 80 in its operative position, at an angle in the range of approximately 30°–35°. This rather slight inclination reduces the risk of undue strain on the knitting yarn when the protrusion 89 acts, as it is intended to do, to push down stitches. In a typical case, the depth of the protrusion 89 is 1 mm measured from the level of the part 91 of the stitch guide surface which precedes the protrusion. The presser foot device is located on the knitting machine so that the surface 90 of the protrusion 89 begins at approximately the start of the upward surface of the raising cam of the machine and ends at approximately the Fleur le Jack position of the needle, that is the surface 90 starts and ends approximately where the line 55 representing the raising cam starts and ends in FIG. 7.

The plate 81, and the corresponding plates in the other presser means (not shown) of the device of FIGS. 10 and 11 also have downward protrusions similar to the protrusion 89 and similarly located. The protrusions serve to increase the downward force on the loops on the rising needles and to reduce the risk of such loops rising with the needles sufficiently to be re-penetrated by the needle hook. This form of presser means is especially useful when knitting with a long stitch length.

What is claimed is:

1. In a presser foot device for a flat V-bed knitting machine with independently operable needles, the device comprising a presser foot carriage adapted for movement along the needle beds of the machine in synchronism with needle operation, and a support element extending, when the device is fitted to the machine, down towards the gap between the walls of the needle beds and resiliently mounted in relation to said carriage for up-and-down movement, the improvement comprising (a) presser means fixedly mounted on said support element, said means having, in operation, leading and trailing ends and being capable of operating over a region extending from in front of the commencement of the rise of the needles for knitting to the area of needle cross-over, (b) a continuous stitch guide surface provided on said means in the neighbourhood of each bed wall and arranged, in the operative position of said presser means, to extend downwardly and rearwardly, and then generally rearwardly, to push down and hold down stitches near said wall, and (c) a resilient presser foot also fixedly mounted on said support element to extend rearwardly from said presser means beneath the needle tent at a height, in the region of the trailing end of said presser means, above said stitch guide surfaces thereof.

2. A device according to claim 1 wherein a pair of presser feet are mounted on said support element and extend in opposite directions therefrom and a pair of presser means are also mounted on said support element and also extend in opposite directions therefrom, and one or other of the presser feet, with its associated presser means, is brought to the operative position by movement of the support element in a vertical plane between the two needle beds.

3. A device according to claim 2 wherein the or each presser means comprises a pair of curved resilient plates.

4. A device according to claim 3 wherein, when the presser device is fitted to a knitting machine, and either presser means is in its operative position, each curved plate of the operative presser means has a portion located in the neighbourhood of a respective bed wall and said trailing end located in the central region between the two needle beds.

5. A device according to claim 4 wherein each of said curved plates curves smoothly from the location near the bed wall to the location in the central region between the two needle beds and has an end region located close to a part of the associated presser foot.

6. A device according to claim 1 wherein each stitch guide surface has a protrusion which, in the operative position of said stitch guide surface, extends downwardly to push down stitches held on rising needles.

7. A device according to claim 5 wherein the pair of plates of each presser means are interconnected in the region of the trailing end of the presser means, the associated presser foot lying above the interconnection which thus restricts the downward but not the upward movement of the presser foot.

8. A presser foot device according to claim 7 comprising a pair of presser means, wherein each two curved plates (belonging to different presser means) associated with the same needle bed wall are formed in one piece together, a base plate located between and integral with each said two curved plates, and a blade of carbon fibre-reinforced composite material fixed to the lower part of said support element and carrying the presser feet which are formed of wire embedded in said composite material, said base plates being secured to said blade.

* * * * *